United States Patent [19]

Schmidt

[11] 4,448,225

[45] May 15, 1984

[54] TOOL TO SUPPLY, TWIST AND CUT ENDS OF A METAL WIRE OR PLASTIC FILAMENT TO PROVIDE A FASTENER

[76] Inventor: Daniel Schmidt, 8, avenue du Petit-Lancy, Petit-Lancy, Switzerland

[21] Appl. No.: 381,377

[22] Filed: May 24, 1982

[30] Foreign Application Priority Data

Jun. 11, 1981 [CH] Switzerland ..... 3819/81

[51] Int. Cl.[3] ..... B21F 7/00

[52] U.S. Cl. ..... 140/119; 140/57

[58] Field of Search ..... 140/117, 118, 119, 121, 140/122, 123, 123.6, 149, 93 A, 93.6, 57

[56] References Cited

U.S. PATENT DOCUMENTS 2,416,002 2/1947 Greer et al. ..... 140/121

3,593,759 7/1971 Wooge ..... 140/118

FOREIGN PATENT DOCUMENTS 554050 4/1977 U.S.S.R. ..... 140/57

*Primary Examiner*—Francis S. Husar
*Assistant Examiner*—Linda McLaughlin
*Attorney, Agent, or Firm*—Emory L. Groff, Jr.

[57] ABSTRACT

The tool comprises pliers (5) mounted in an extension of a shaft (2) mounted to rotate around its axis in tubular sleeve (4). Metal wire (14) can be engaged in an axial bore (12) of shaft (2) and between the jaws of pliers (5). The tool makes it possible to fasten two elements (17,18) to one another by means of the wire (14) by a pull exerted on the sleeve (15) of the tool which, in a first stage, wraps the ends of the fastener engaged between the jaws of the pliers (5), around one another, and, in a second stage, separates the fastener from the wire (14).

1 Claim, 2 Drawing Figures

TOOL TO SUPPLY, TWIST AND CUT ENDS OF A METAL WIRE OR PLASTIC FILAMENT TO PROVIDE A FASTENER

This invention relates to a tool for delivering, twisting and cutting the ends of a metal wire or plastic filament to provide a fastener.

A tool is already known for forming a fastener by simultaneous twisting of the ends of a metal wire, each of which is provided with a loop, by rotating a hook engaged in the loops. The hook is fastened to one of the ends of a shaft engaged in a tubular sleeve, the rotation thereof being assured by a helicoidal guide ramp under the action of a pull exerted on the sleeve against the action of a return spring. The cost of such metal wires provided with loops is relatively high, and depending on the perimeter of the fastener to be made, wires of different length having loops at their end have been used.

The object of the present invention is to provide a tool which makes it possible to form fasteners with any size perimeter from a roll of metal wire or plastic filament. Generally, the invention comprises cutting pliers mounted coaxially in an extension of a head of a shaft having an axial bore for passage of wire in the direction of the jaws of the pliers. A tubular sleeve surrounds the shaft which is engaged with means for rotatably driving it and is characterized in that the pliers are housed in a tubular extension of the head of the shaft, the jaws thereof projecting from the free end of the tubular extension while the plier handles project through oppositely disposed longitudinal slots in the tubular extension.

The accompanying drawing illustrates diagrammatically and by way of example of a preferred embodiment of the tool according to the invention wherein.

Figure 1:
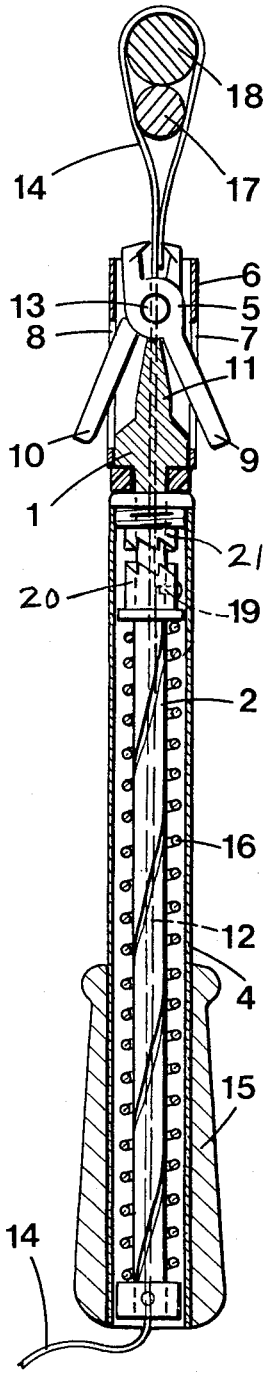
FIG. 1 is an axial section of the tool before twisting of the wire.

The tool shown in the drawing comprises a head 1 integral with one end of a shaft 2 which is provided with a helicoidal groove 3. The shaft is disposed coaxially within a tubular sleeve 4. Cutting pliers 5 are housed in a tubular extension 6 of head 1 which is provided with oppositely disposed lengthwise slots 7 and 8. Handles 9 and 10 of the pliers 5 are engaged in slots 7 and 8 on both sides of a polyhedral extension 11 of the head 1, while the jaws of pliers 5 are disposed in the open end of tubular extension 6. Shaft 2 and head 1 are provided with an axial bore 12, which extends transversely of the pin 13 of the jaws of pliers 5.

Thus, it is possible to introduce metal wire 14 into the axial bore 12 at that end of the tool which is provided with handle 15, and to pull the wire out of the opposite end of the tool between the jaws of pliers 5. Shaft 2 is held in tubular sleeve 4 by a return spring 16 which maintains the jaws of pliers 5 in an open position. Under these conditions, it is possible to pull out the free end of wire 14, wrap it around pieces 17 and 18 which are to be fastened together, and reintroduce the free end of the fastener, thus prepared, between the open jaws of pliers as shown in FIG. 1.

Then, it handle 15 is pulled, the jaws of pliers 5 close on the two twisted portions of wire 14, because handles 9 and 10 of pliers 5 are locked against one another by the ends of slots 7 and 8, and the jaws of pliers 5 project from the free end of tubular extension 6.

Figure 2:
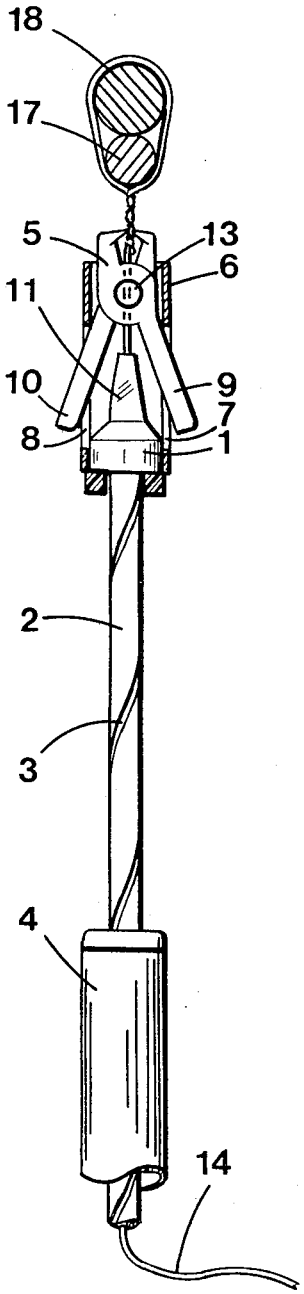
FIG. 2 is an elevational view, partially in section, after twisting of the wire.

A lug 19 integral with a lowermost toothed member 20 of a clutch is engaged in a helicoidal groove 3 in shaft 2. The toothed member 20 of the clutch is held in its upper position by a spring 16. The uppermost toothed member 21 is screwed onto the upper end of sleeve 4 as shown in FIG. 1. When handle 15 is pulled, the sleeve 4 moves away from its FIG. 1 position to the FIG. 2 position causing the teeth of clutch member 21 to mesh with the teeth of clutch member 20. The lug 19 being engaged in groove 3 of the shaft 2 drives the jaws of pliers 5 into gripping engagement with wire 14 and imparts a rotational movement thereto which winds the ends of the wire around one another and then separates the thus formed fastener from the strand of wire 14 by closing the jaws of pliers 5 to impart a cutting movement thereto.

Once the fastener has been separated from the rest of wire 14, the jaws of pliers 5 open because their handles 9 and 10 are no longer locked against one another by the ends of slots 7 and 8. The jaws of pliers 5 again resume the retracted position shown in FIG. 1, while shaft 2 is simultaneously retracted into sleeve 4 by the return spring 16.

Then, all that is required to form another fastener is to grasp the free end of wire 14 which projects from the open jaws of pliers 5 and pull out a new length of wire, wrap it around other pieces 17 and 18, attach one of them to the other and repeat said operation as many times as desired until the available supply of wire 14 is used up.

Reloading of the tool with wire, as described, is very simple and can be done rapidly.

The tool has various applications, particularly with reference to closing bags, attaching vinestock to their stakes or tying concrete reinforcement rods.

I claim:

1. A tool to supply, twist and cut a portion of a metal wire (14) to form a fastener, said tool comprising a shaft (2), a head (1) integral with one end of said shaft (2) and including a tubular extension (6) having oppositely disposed longitudinal slots (7,8) therein, said head and shaft having an axial bore therein for receiving a length of wire, cutting pliers (5) mounted in said extension above said head and including a pair of pivotally connected handles (9,10), a cutting jaw at the end of each of said handles, a tubular sleeve (4) in which said shaft (2) is mounted, said plier jaws projecting from the free end of said tubular extension (6), said plier handles (9,10) projecting through said longitudinal slots (7,8), drive means for rotatably driving said shaft, said head, said extension and said pliers, said drive means including a helicoidal groove on said shaft, clutch means comprising a first toothed member secured in the upper end of said sleeve, a second toothed member slidably mounted on said shaft, a lug on said second toothed member engaged in said helicoidal groove on said shaft, a return spring surrounding said shaft and abutting the bottom of said second toothed member at one end and at the other end abutting a stop member at the end of said shaft opposite said head, said spring normally supporting said second toothed member in a position spaced from said first toothed member whereby upon sliding said sleeve longitudinally relative to said shaft against the action of said spring and away from said head, said first and second toothed members are engaged to rotate said shaft, said head, said extension and said pliers to twist portions of said wire around one another and cut them.

* * * * *